US010487416B2

(12) United States Patent
Trimmer et al.

(10) Patent No.: US 10,487,416 B2
(45) Date of Patent: Nov. 26, 2019

(54) ELECTROCHEMICAL MACHINING EMPLOYING ELECTRICAL VOLTAGE PULSES TO DRIVE REDUCTION AND OXIDATION REACTIONS

(71) Applicant: GENERAL ELECTRIC COMPANY, Schenectady, NY (US)

(72) Inventors: Andrew Lee Trimmer, Niskayuna, NY (US); John Cottrill, Franklin, OH (US); Douglas Lewis, Woodstock, VT (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 267 days.

(21) Appl. No.: 14/739,109

(22) Filed: Jun. 15, 2015

(65) Prior Publication Data

US 2016/0362810 A1 Dec. 15, 2016

(51) Int. Cl.
*C25F 3/02* (2006.01)
*C25F 7/00* (2006.01)

(52) U.S. Cl.
CPC . *C25F 3/02* (2013.01); *C25F 7/00* (2013.01)

(58) Field of Classification Search
CPC .. B23H 3/02; B23H 2300/00; B23H 2500/00; B23H 2600/10; B23H 2300/12; B23H 7/18
See application file for complete search history.

(56) References Cited

U.S. PATENT DOCUMENTS 3,062,192 A * 11/1962 Webb ..... B23H 7/30 60/378
3,357,906 A 12/1967 Jollis et al.
3,616,346 A * 10/1971 Inoue ..... B23H 3/02 204/229.5
3,654,116 A * 4/1972 Inoue ..... B23H 3/02 204/224 M
3,975,245 A 8/1976 Berquist et al.
4,026,779 A * 5/1977 Shaw ..... B23H 3/08 205/685
6,203,684 B1 * 3/2001 Taylor ..... B23H 5/08 205/103

(Continued)

FOREIGN PATENT DOCUMENTS

WO WO 2006111345 A1 * 10/2006 ..... B23H 3/02

OTHER PUBLICATIONS

Zaytsev et al. (WO 2006/111345 A1, Machine Translation).*

(Continued)

*Primary Examiner* — Maris R Kessel
*Assistant Examiner* — Joshua L Allen
(74) *Attorney, Agent, or Firm* — Christopher R. Carroll; The Small Patent Law Group

(57) ABSTRACT

Electrochemical machining of parts employs electric or voltage pulses in which current flows in a first direction and a second direction opposite from the first direction. The cathodic/anodic pulses switch between bulk machining and oxide removal pushing bulk material removal into a homogenous regime to obtain a smooth surface finish and appropriate form control during the electrochemical machining process compared to electrochemical machining employing an electric or voltage potential in which current flows in only one direction.

22 Claims, 5 Drawing Sheets

(56) References Cited

U.S. PATENT DOCUMENTS

| | | | | |
|---|---|---|---|---|
| 6,231,692 | B1 | 5/2001 | Vogt et al. | |
| 6,319,384 | B1 * | 11/2001 | Taylor | B23H 5/08 205/103 |
| 6,402,931 | B1 * | 6/2002 | Zhou | B23H 3/02 204/DIG. 9 |
| 6,558,231 | B1 | 5/2003 | Taylor | |
| 6,723,223 | B2 | 4/2004 | Zaitsev et al. | |
| 6,946,062 | B2 * | 9/2005 | Lin | C25F 7/00 204/224 M |
| 7,356,122 | B2 | 4/2008 | Raber et al. | |
| 7,394,040 | B2 | 7/2008 | Wei et al. | |
| 7,741,576 | B2 | 6/2010 | Trimmer et al. | |
| 7,976,694 | B2 | 7/2011 | Trimmer et al. | |
| 8,262,897 | B2 | 9/2012 | Bayer et al. | |
| 8,906,221 | B2 | 12/2014 | Holmes et al. | |
| 8,974,656 | B2 | 3/2015 | Trimmer et al. | |
| 2002/0033341 | A1 * | 3/2002 | Taylor | B23H 5/08 205/103 |
| 2005/0098445 | A1 * | 5/2005 | Batzinger | B23H 3/02 205/644 |
| 2005/0145508 | A1 * | 7/2005 | Larsen | A61L 31/022 205/684 |
| 2006/0257244 | A1 * | 11/2006 | Steplewski | B23P 6/005 415/115 |
| 2009/0008265 | A1 * | 1/2009 | Bayer | B23H 3/00 205/654 |
| 2011/0303553 | A1 * | 12/2011 | Inman | B23H 3/02 205/659 |
| 2016/0031026 | A1 * | 2/2016 | Taylor | B23H 5/08 205/642 |

OTHER PUBLICATIONS

Li, et al; "Cathode Design of Aero-engine Blades in Electrochemical Machining Based on Characteristics of Electric and Electrolyte Flow Field," Proceedings of the IEEE International Conference on Automation and Logistics, Sep. 2008, pp. 1469-1473, Qingdao, China.

Hongyou, et al; "Research on Technique of Pulse Electrochemical Surface Finishing," International Conference on Measuring Technology and Mechatronics Automation, 2009, pp. 677-680.

Inman, et al; "Electropolishing of Passive Materials in HF-Free Low Viscosity Aqueous Electrolytes," Journal of the Electrochemical Society, 2013, pp. E94-E98, vol. 160, issue 9.

Sabareesaan, et al; "Evaluation of Process parameter ranks in Electric Discharge Machining of Aerospace super alloy using copper Electrode," 2nd International Conference on Current Trends in Engineering and Technology, Jul. 8, 2014, pp. 556-560, Coimbatore, India.

Taylor, et al; "Electrochemical Surface Finishing," The Electrochemical Society Interface, Fall 2014, pp. 57-61.

Taylor, et al; "A Pulse/Pulse Reverse Electrolytic Approach to Electropolishing and Through-Mask Electroetching," Products Finishing, Sep. 26, 2011.

* cited by examiner

ELECTROCHEMICAL MACHINING EMPLOYING ELECTRICAL VOLTAGE PULSES TO DRIVE REDUCTION AND OXIDATION REACTIONS

TECHNICAL FIELD

The present disclosure generally relates to electrochemical machining, and more particularly, to electrochemical machining employing electrical voltage pulses to drive reduction and oxidation reactions such as for forming nickel-based alloy turbine blades

BACKGROUND

Electrochemical machining is a method of removing metal by an electrochemical process. It is typically used for working electrically conductive materials that are extremely hard or that are difficult to machine using conventional methods. For example, electrochemical machining is used to produce complicated shapes such as compressor blades with good surface finish in difficult to machine materials.

Electrochemical machining is often characterized as "reverse electroplating", in that it removes material instead of adding it. During electrochemical machining, metal is dissolved from a workpiece with direct current at a controlled rate in an electrolytic cell. The workpiece serves as the anode and is separated by a gap from an electrode or tool, which serves as the cathode. The electrolyte, usually a salt solution in water, is pumped through the gap, flushing away metal dissolved from the workpiece. As the electrode tool moves towards the work piece to maintain a constant gap, the workpiece is machined into the complementary shape of the tool.

There is a need for further methods for electrochemical machining, and more particularly, to electrochemical machining employing electrical voltage pulses to drive reduction and oxidation reactions such as for forming nickel-based alloy turbine blades.

SUMMARY

The present disclosure provides, in a first aspect, a method for electrochemical machining a metallic workpiece. The method includes providing a metallic substrate, providing an electrode, providing an electrolyte between the substrate and the electrode, applying a plurality of electric potential pulses over a period of time to cause current flow between the electrode and the substrate, and moving the electrode and/or the substrate toward each other while applying the plurality of electric potential pulses over the period of time to electrochemically machine a portion of the substrate. A first plurality of the plurality of electric potential pulses has a first electric potential and a first duration to cause current flow in a first direction between the electrode and the substrate to drive a reduction process, and a second plurality of the plurality of electric potential pulses has a second electric potential and second duration to cause current flow in a second direction opposite to the first direction between the electrode and the substrate to drive oxide removal. The first electric potential is greater than the second electric potential, the first duration is greater than the second duration, and the first plurality of the plurality of electric potential pulses being interspersed with the second plurality of the plurality of electric potential pulses. The electrochemically machined substrate after the period of time includes a surface having an average arithmetic surface roughness less than a surface roughness of an electrochemically machined substrate formed with an applied electric potential resulting in current flow in only one direction.

The present disclosure provides, in a second aspect, a method for use in electrochemical machining nickel-based alloy blades. The method includes providing a nickel-based alloy substrate, providing an electrode, providing an aqueous electrolyte between the substrate and the electrode, applying a plurality of electric potential pulses over a period of time to cause current flow between the electrode and the substrate, and moving the electrode and/or the substrate toward each other while applying the plurality of electric potential pulses over the period of time to electrochemically remove a portion of the substrate having a thickness about 0.020 inch to about 0.10 inch to form at least a portion of the blade. A first plurality of the plurality of electric potential pulses has a first electric potential and a first duration to cause current flow in a first direction between the electrode and the substrate to drive a reduction process, and a second plurality of the plurality of electric potential pulses has a second electric potential and second duration to cause current flow in a second direction opposite to the first direction between the electrode and the substrate to drive oxide removal. The first electric potential is greater than the second electric potential, the first duration is greater than the second duration, and the first plurality of the plurality of electric potential pulses being interspersed with the second plurality of the plurality of electric potential pulses. The electrochemically machined substrate after the period of time includes a surface having an average arithmetic surface roughness between about 10 microinch and about 20 microinch.

The present disclosure provides, in a third aspect, an apparatus for use in electrochemical machining an electrically conductive substrate using an electrochemical machining device including a tool electrode and an electrolyte disposed in a gap between the substrate and the tool electrode. The apparatus includes a power supply electrically connected to the electrically conductive substrate and the tool electrode for providing electrical power to the electrically conductive substrate and the tool electrode, and a controller operably connected to the power supply. The controller and the power supply are operable for applying a plurality of electric potential pulses over a period of time to cause current flow between the electrode and the substrate while the electrode and/or the substrate is moved toward each other, a first plurality of the plurality of electric potential pulses having a first electric potential and a first duration to cause current flow in a first direction between the electrode and the substrate to drive a reduction process, and a second plurality of the plurality of electric potential pulses having a second electric potential and second duration to cause current flow in a second direction opposite to the first direction between the electrode and the substrate to drive oxide removal, the first electric potential being greater than the second electric potential, the first duration being greater than the second duration, and the first plurality of the plurality of electric potential pulses being interspersed with the second plurality of the plurality of electric potential pulses. The electrochemically machined substrate after the period of time includes a surface having an average arithmetic surface roughness less than a surface roughness of an electrochemically machined substrate formed with an applied electric potential resulting in current flow in only one direction.

DRAWINGS

The foregoing and other features, aspects and advantages of this disclosure will become apparent from the following detailed description of the various aspects of the disclosure taken in conjunction with the accompanying drawings, wherein.

DETAILED DESCRIPTION

Figure 1:
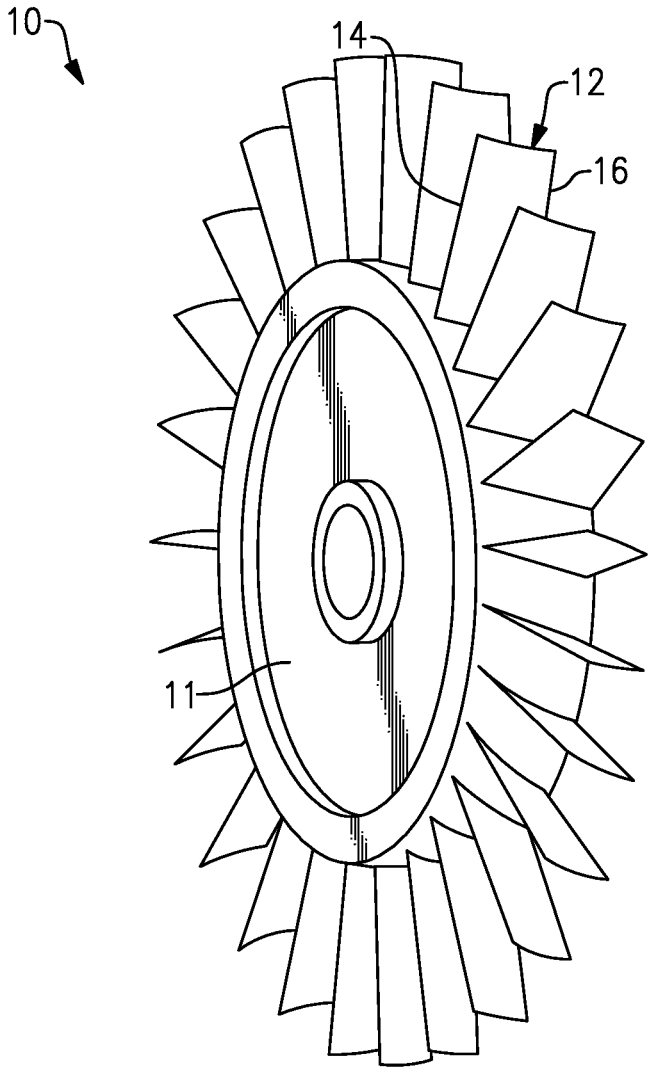
FIG. 1 is a perspective view of a gas turbine rotor having a plurality of blades formed by an electrochemical process in accordance with aspects of the present disclosure.

The detailed description facilitates the explanation of certain aspects of the disclosure, and should not be interpreted as limiting the scope of the disclosure. Moreover, approximating language, as used herein throughout the specification and claims, may be applied to modify any quantitative representation that could permissibly vary without resulting in a change in the basic function to which it is related. Accordingly, a value modified by a term or terms, such as "about," is not limited to the precise value specified. In some instances, the approximating language may correspond to the precision of an instrument for measuring the value. When introducing elements of various embodiments, the articles "a," "an," "the," and "said" are intended to mean that there are one or more of the elements. The terms "comprising," "including," and "having" are intended to be inclusive and mean that there may be additional elements other than the listed elements. As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances, the modified term may sometimes not be appropriate, capable, or suitable. Any examples of operating parameters are not exclusive of other parameters of the disclosed embodiments. Components, aspects, features, configurations, arrangements, uses and the like described, illustrated or otherwise disclosed herein with respect to any particular embodiment may similarly be applied to any other embodiment disclosed herein.

The present disclosure is directed to forming difficult to machine metallic parts, and more specifically, to electrochemical machining of parts employing electric or voltage pulses in which current flows in a first direction and a second direction opposite from the first direction. For example, the technique of the present disclosure employs alternating cathodic/anodic pulses that switch between bulk machining (oxidation process in which the metal dissolves out) and oxide removal pushing bulk material removal into a homogenous regime to obtain smooth surface finish and appropriate form control during the electrochemical machining process compared to electrochemical machining employing an electric or voltage potential in which current flows in only one direction. The present technique provides electrochemical machining employing electrical voltage pulses causing specific, desirable electrochemical reactions for electrochemically machining specific alloy chemistries of nickel-based blades. For example, operating conditions are operable to enable electromechanical machining of, for example, nickel-based alloys, such as Rene 80 and Rene 108 having a high hardness and are difficult to machine with conventional methods, a high melting point, that yield a smooth surface finish and appropriate form control for manufacturing compressor airfoils such as blades for gas turbines, jet engines, and power generation.

FIG. 1 illustrates a gas turbine rotor 10 manufactured using the electrochemical machining process in accordance with aspects of the present disclosure. Gas turbine rotor 10 includes a rotor disk 11, as well as a plurality of rotor blades 12 distributed over the circumference of rotor disk 11. The blades may be integral to the rotor or may be operably attachable to a separate rotor. Blades 12 generally include a leading edge 14, and a trailing edge 16. Blades 12 generally includes a convex side and a concave side. The gas turbine rotor may be fabricated from a nickel-based alloy or include separately attachable blades fabricated from a nickel-based alloy that are attachable to a rotor disk.

Figure 2:
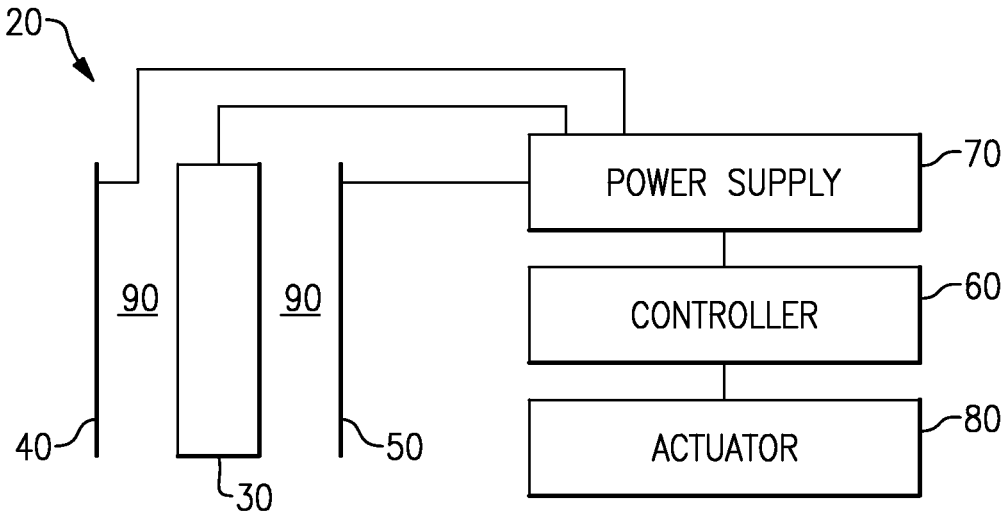
FIG. 2 is a diagrammatic illustration of an electrochemical machining system for electrochemically machining a substrate in accordance with aspects of the present disclosure for forming at least a portion of the gas turbine rotor of FIG. 1.

FIG. 2 is a diagrammatic illustration of an electrochemical machining system 20 for electrochemically machining a workpiece or substrate 30, such at least a portion of a turbine blade, in accordance with aspects of the present disclosure. Electrochemical machining system 20 may include a first tool electrode 40, a second tool electrode 50, a controller 60, a power supply 70, and an actuator 80. Controller 60 may be operably connected to power supply 70 for controlling the voltage to the workpiece or substrate 30, first tool electrode 40, and second tool electrode 50, and operably connected to an actuator 80 for controlling movement of the electrode tools and/or the substrate toward each other during the electrochemically machining process. The controller and power supply may be separate units or be a combination power supply and controller. The power supply or the combination of the power supply and controller is operable to provide a DC pulsed power supply. An electrolyte 90 is disposed in the gap between the substrate and the electrodes. For example, the electrolyte may be suitably continuously forced though the gap using a pump to rinse the substrate and the electrode. In some embodiments, the first tool electrode and the second tool electrode may form a clam shell electrode. The electrolyte may be a base, an acid, or an ionic liquid. The electrolyte may be an aqueous electrolyte such as an aqueous salt electrolyte including water and a salt. For example, the electrolyte may be 10 percent aqueous solution of sodium nitrate (by weight) to about 30 percent (saturation point) such as about a 20 percent aqueous solution of sodium nitrate (by weight) for electrochemically machining nickel-based alloys such as Rene 80. It will be appreciated that other aqueous solution electrolytes may be employed with the technique of the present disclosure. The electrode may be formed from a copper tungsten material, brass, copper, niobium, commercially pure titanium, and other suitable materials.

The substrate may be casted, forged, or machined (such as electrochemically machined using a constant or pulsed DC voltage), or otherwise formed to an oversized configuration. The initial configuration may provide the blades integral to the rotor or provide a plurality of separate blades that are later attached to a rotor. The initial substrate such as a nickel-based alloy substrate is then followed by the electrochemical machining process generally to final form or contour.

The contour of each tool electrode is adapted to the contour of desired surface of the turbine blade to be produced. For example, the tool electrode may include a second configuration the reverse of which is different from the first configuration. It will be appreciated that the electrochemical machining process may be employed with a single electrode tool that extends along or wraps around a side or more than one side of the workpiece or substrate. The electrochemical machining process may also be employed with a first electrode tool disposed along one surface for electrochemically machining a first surface, and a second electrode tool disposed along another surface for electrochemically machining a second surface. While the substrate may remain stationary during the electrochemical process and the electrodes moved toward the substrate by the actuator, it will be appreciated that in other embodiments the substrate and/or the electrodes may be stationary or may be made to move.

Figure 3:
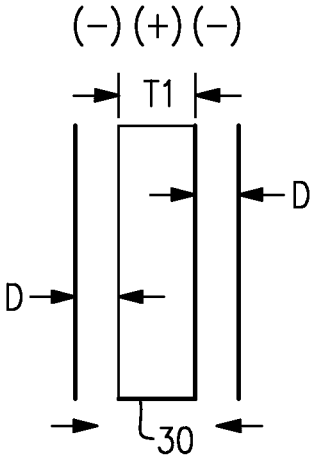
FIGS. 3 and 4 are diagrammatic illustrations of an initial electrochemical machining setup having a substrate disposed between two tool electrodes.
Figure 4:
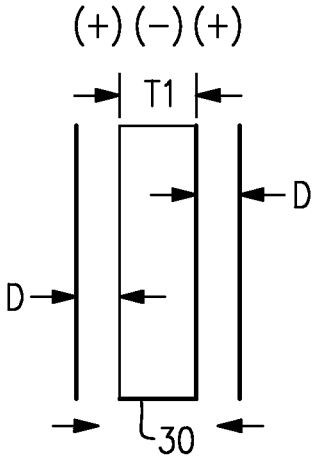

FIGS. 3 and 4 illustrate an initial set up for an electrochemical machining process in accordance with the present disclosure. For example, substrate 30 may have a first or initial configuration having, for example, an initial thickness T1. During the electrochemical machining process, a gap D is maintained between the substrate and the electrodes. For example, the gap may be about 0.010 inch to about 0.014 inch, or other suitable gap size. In particular, as described in greater detail below, a plurality of electric potential pulses are applied over a period of time to cause current flow between the electrode and the substrate. For example, as shown in FIG. 3, a pulse may be applied resulting in the substrate being at a positive electric potential and the electrodes being at a negative electric potential to cause current flow in a first direction between the electrode and the substrate. As shown in the FIG. 4, a pulse may be applied resulting in substrate 30 being at a negative electric potential and the electrodes being at a positive electric potential to cause current flow to in a second opposite direction between the electrode and the substrate.

Figure 5:
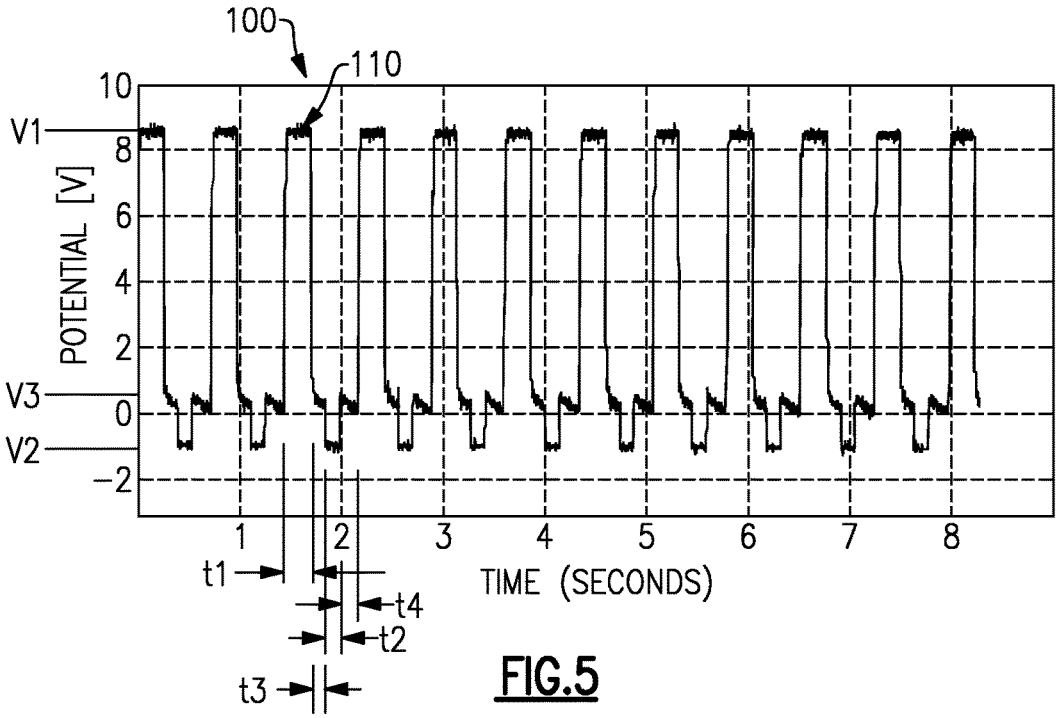
FIG. 5 is a graph of voltage verses time for an electrochemical machining process in accordance with the present disclosure for forming electrochemical machining the substrate.

FIG. 5 illustrates a graph of a pulse train or a plurality of electric potential pulses 100 applied over a period of time to cause current flow between the electrode and the substrate such as a Rene 80 nickel-based alloy. For example, a first plurality 110 of the plurality of pulses may have a first electric potential V1 and a first duration t1 to cause current flow in a first direction between the electrode and the substrate, and a second plurality of the pulses 120 may have a second electric potential V2 and second duration t2 to cause current flow in a second direction opposite to the first direction between the electrode and the substrate. As shown in FIG. 5, the first electric potential V1 may be greater than the second electric potential V2, the first duration t1 may be greater than the second duration t2, and the first plurality of the plurality of pulses may be interspersed with the second plurality of the plurality of pulses. The first electric potential pulses may result in bulk machining (an oxidation process in which the metal dissolves from the surface), and the second electric potential pulses may result in oxide removal (reduction of the oxide). In addition, first plurality 110 of the plurality of pulses may have a high electric potential at V1 for first duration t1 and a low electric potential V3 for a duration t3 both of which cause current flow in the first direction between the electrode and the substrate. The high electric potential may provide bulk machining while the low electric potential maintains activity (an established electrochemical double layers at each electrode/electrolyte interface) at the surface and may be based on the breakdown potential of the substrate material. The low electric potential may occur before or after the high electric potential. A transition time t4 may occur when switching from the second electric potential to the first electric potential may be due to the switching speed or reactivity of the power supply.

For example, for electrochemically machining a nickel-based alloy, such as Rene 80, having good resulting surface finish, V1 may be about 8 volts, V2 may be about −1 volt, t1 may be about 0.25 second, t2 may be about 0.125 second, and t3 may be about 50 milliseconds. The low second voltage V2 may limit likelihood of the tool electrode being dissolved. In other embodiments, the time duration of the electric potential of the first plurality of pulses may be about 0.1 second to about 1 second, and the time duration of the electric potential of the second plurality of pulses may be about 0.1 second to about 0.125 second. The desired values may be dependent of the substrate material such as the metal or metal alloy to be electrochemically machined. For tool electrodes formed from copper tungsten has a tenacious oxide that may limit the likelihood of the tool electrode being dissolved with the use of a low second voltage. In one embodiment, the plurality of pulses may be alternating electric potentials that switch periodically back and forth.

Figure 6:
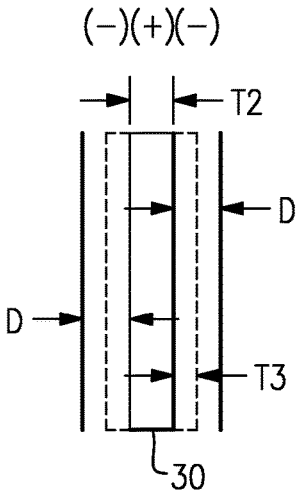
FIGS. 6 and 7 are diagrammatic illustrations of the electrochemical setup and substrate of FIGS. 2 and 3 after undergoing electrochemical machining.
Figure 7:
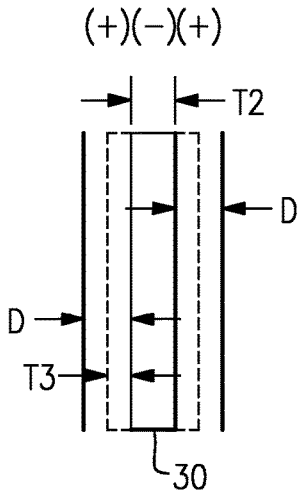

As shown in FIGS. 6 and 7, the electrochemical machining process results in substrate 30 having a machined thickness T2. For example, a thickness T3 of the substrate (shown in dashed lines) of about 0.02 inch, about 0.03 inch, about 0.04 inch, about 0.05 inch, about 0.06 inch, about 0.07 inch, about 0.08 inch, about 0.09 inch, about 0.1 inch or other suitable thickness may be electrochemically machined or removed from each side of the substrate. During the electrochemical machining process a constant gap may be maintained between the tool electrode and the substrate. For example, the gap may maintained to be about 0.030 inch, 0.040 inch, 0.050 inch, or 0.060 inch, or other suitable gap size, or varying gap sized during the electrochemical process. Movement of the tool electrode toward the substrate or feed rate may range between about 0.02 inches to about 0.25 inches per minute, between 0.01 to 0.08 inches per minute, about 0.03 inches per minute, or other suitable feed rates. At a 0.03 inches per minute, a thickness of the substrate of about 0.03 inches may be cut in about a minute. It will be appreciated that the feed rate may initially be greater or faster to engage the process and then stabilize the feed rate to maintain a consistent gap on a specific geometry.

In one embodiment, the electrochemical machining process switches back and forth between the electric potentials resulting in current flowing in one direction from the electrode to the substrate and current flowing in the opposite direction from the electrode to the substrate. The pulse frequency for applied electric potentials may be between about 4 Hz and about 20 Hz, and preferably about 8 Hz. During the electrochemical process, the applied positive pulses result in bulk electrochemical machining (metal dissolution or oxidation reaction where the metal dissolves and loses an electron(s) to form metal ions), and the applied negative pulses result in surface cleaning and oxide removal (attack or removing oxides formed during the bulk electrochemical machining such as oxide having chromium, cobalt, and/or molybdenum) thereby reducing the likelihood of the formation of pits or uneven surface finish.

In some embodiment, the first electric potential pulses may be in the range between about 8 volts and about 28 volts, and the second electric potential pulses includes about 0.5 volts to about 10 volts. The desired values may be dependent of the substrate material such as the metal or metal alloy to be electrochemically machined.

The present technique is applicable for electrochemically machining super alloys such as nickel-based alloys, including Rene 80 and Rene 108. Rene 80 may include about 60 percent nickel, 14 percent chromium, 10 percent cobalt, 5 percent titanium, 4 percent molybdenum, 4 percent tungsten, 3 percent aluminum, 0.17 percent carbon, and 0.015 percent boron, and 0.03 percent zirconium. Rene 108 may include about 62 percent nickel, 9.5 percent cobalt, 9.5 percent tungsten, 8.4 percent chromium, 5.5 percent aluminum, 3.05 percent tantalum, and 1.50 percent hafnium.

Example

Initial electrochemical machining studies involved a series of cyclic voltammagrams in which the voltammagram represented the current response of Rene 80 in a 20% solution of sodium nitrate by weight buffered with sodium hydroxide to a pH of 9. The scan began at the open circuit potential where the current is zero. Scanning anodically (positive potential), the current rose exponentially and then plateaued at ×1, ×2 and then later at potential above 2 V. Each plateau represented a current limited regime where the surface dissolution rate of the alloy was limited by oxide formation and later charge transfer. Operating conditions were suggested by this information, essentially it drives the idea that certain potential regions, and given electrolyte flow rates and electrode gaps, will yield surface products that limit material removal. Moving cathodically (negative in potential), showed the surface inhibition can be broken down thus refreshing the surface for anodic potentials that will drive bulk material removal.

A set up for electrochemical machining in accordance with the present disclosure included a Rene 80 nickel-based super alloy workpiece, an electrolyte including a 20 percent solution of sodium nitrate by weight buffered with sodium hydroxide to a pH of 9. In this case, a pulse train included 8 volts for 0.25 second, 0.5 volts for 0.05 second, and −1.0 volts for 0.125 second (e.g., as shown in FIG. 5). An electrolyte pressure was 100 psi, and a starting machining gap was 0.01 inches. Conditions like these alternate between bulk material removal and oxide scrubbing to yield a smooth surface for Rene 80. In particular, the pulse train and flushing condition yielded a surface having about a 20 microinches Ra roughness or better. The electrochemically machined workpiece, if required by design, may be polished to have a surface finish less than about 10 microinches such as about 4 microinches.

Figure 8:
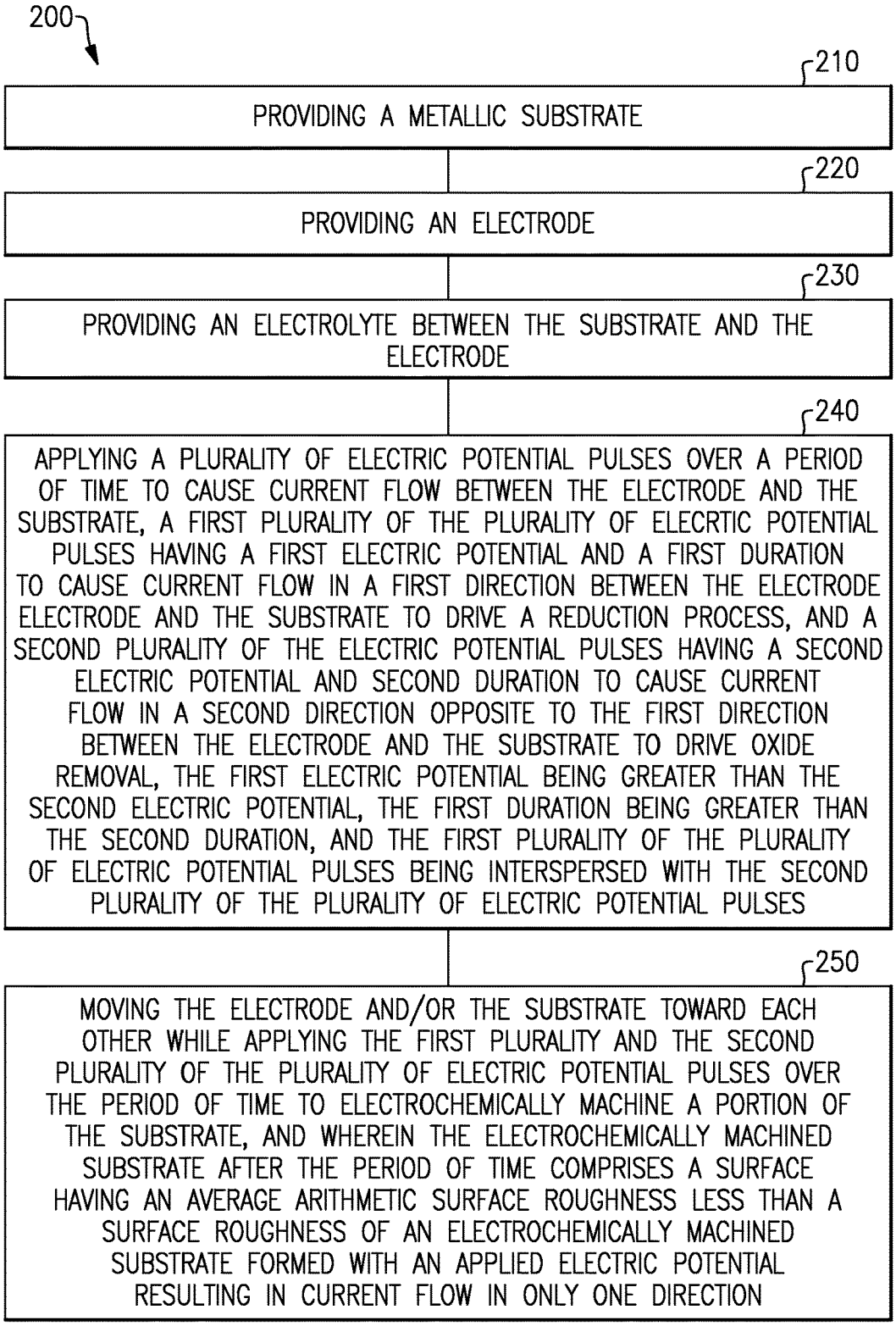
FIG. 8 is a flowchart of a method for electrochemical machining a metallic workpiece in accordance with aspects of the present disclosure.

FIG. 8 illustrates a method 200 for electrochemical machining a metallic workpiece in accordance with aspects of the present disclosure. Method 200 includes at 210 providing a metallic substrate, at 220 providing an electrode, and at 230, providing an electrolyte between the substrate and the electrode. At 240, a plurality of electric potential pulses over a period of time is applied to cause current flow between the electrode and the substrate. A first plurality of the plurality of electric potential pulses has a first electric potential and a first duration to cause current flow in a first direction between the electrode and the substrate, and a second plurality of the electric potential pulses has a second electric potential and second duration to cause current flow in a second direction opposite to the first direction between the electrode and the substrate. The first electric potential is greater than the second electric potential, the first duration is greater than the second duration, and the first plurality of the plurality of electric potential pulses is interspersed with the second plurality of the plurality of electric potential pulses. At 250, the electrode and/or the substrate is moved toward each other while applying the plurality of electric potential pulses over the period of time to electrochemically machine a portion of the substrate. The electrochemically machined substrate after the period of time includes a surface having an average arithmetic surface roughness less than a surface roughness of an electrochemically machined substrate formed with an applied electric potential resulting in current flow in only one direction.

Figure 9:
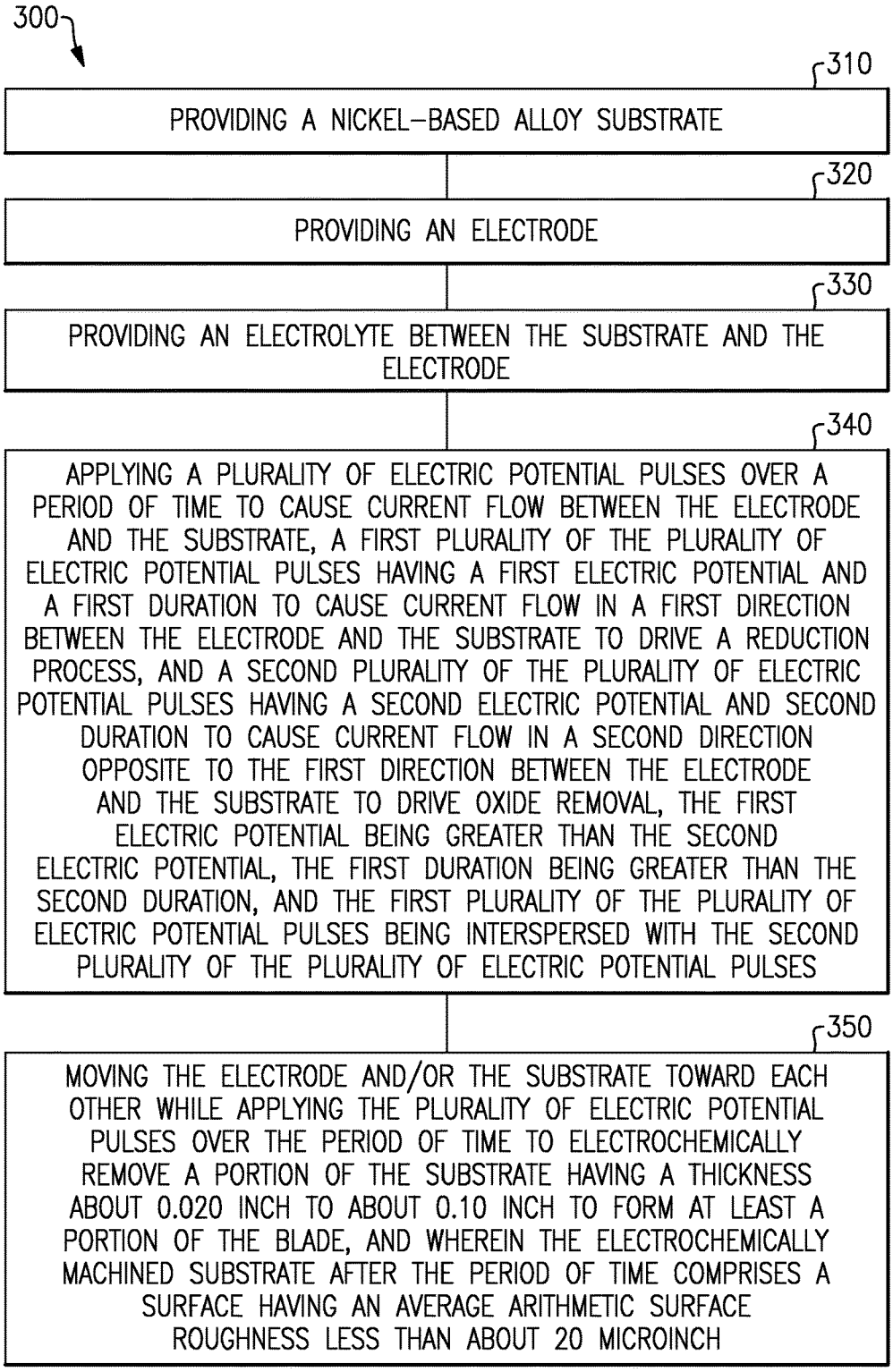
FIG. 9 is a flowchart of a method for use in electrochemical machining nickel-based alloy turbine blades in accordance with aspects of the present disclosure.

FIG. 9 illustrates a method 300 for electrochemical machining a nickel-based alloy workpiece in accordance with aspects of the present disclosure. Method 300 includes at 310, providing a nickel-based alloy substrate, at 320 providing an electrode, at 330 providing an electrolyte between the substrate and the electrode. At 340, a plurality of electric potential pulses are applied over a period of time to cause current flow between the electrode and the substrate. A first plurality of the plurality of electric potential pulses have a first electric potential and a first duration to cause current flow in a first direction between the electrode and the substrate, and a second plurality of the plurality of electric potential pulses have a second electric potential and second duration to cause current flow in a second direction opposite to the first direction between the electrode and the substrate. The first electric potential is greater than the second electric potential, the first duration is greater than the second duration, and the first plurality of the plurality of electric potential pulses is interspersed with the second plurality of the plurality of electric potential pulses. At 350, the electrode and/or the substrate is moved toward each other while applying the plurality of electric potential pulses over the period of time to electrochemically remove a portion of the substrate having a thickness a thickness about 0.020 inch to about 0.10 inch to form at least a portion of the turbine blade. The electrochemically machined substrate after the period of time includes a surface having an average arithmetic surface roughness between about 10 microinch and about 20 microinch.

It will be appreciated that the technique of the present disclosure addresses the problems associated with, for example, difficult to machine alloys such as Rene alloys that are difficult for electrochemical machining due to high percentages of chromium, cobalt, tungsten, rhenium, and molybdenum. Typically, such alloy constituents form oxides that make normal direct current electrochemical machining problematic particularly with direct current electrochemical machining which allows oxide formation of certain alloy constituents that drive inhomogeneous dissolution rates and results in rough surfaces. The present technique reduces if not removes the need to include additions of harsh chemical additives like hydrofluoric, nitric, and perchloric acid that would chemically remove the oxide in order to keep the anodic electrochemical machining removal step homogenous. As described above, the technique of the present disclosure employs, for example, alternating cathodic/anodic pulses that switch between bulk machining and oxide removal moves bulk material removal into a homogenous regime resulting in smooth surfaces which are particularly desired in airfoil machining. The present electrochemical machining technique impart three dimensional structure in a workpiece in a facile way without damaging the grain structure such as in Rene alloys. The present electrochemical machining technique may also be applicable in electrochemical machining of titanium alloyed with aluminum, vanadium, tin, chromium, molybdenum, and zirconium. Other workpieces for such electrochemical machining may include iron, chromium, vanadium, molybdenum, titanium, and aluminum alloys. It will be appreciated that other metallic materials and metallic materials discovered in the future may be suitable for such electrochemical machining.

From the present description, the present electrochemical machining process may produce airfoils in single machining operations that are cost effective compared to conventional methods like milling that take longer and consume tooling and cutters. The resulting electrochemical machined part in accordance with the present disclosure includes smooth surfaces simplify the overall airfoil manufacturing process map by eliminating subsequent operations that would otherwise be required to smooth the airfoil surface. In addition, maintaining a relatively small electrode gap during the electrochemical machining process operations not only produce a smooth surface but also parts with high geometric fidelity compared to engineering intent with respect to aerodynamic performance. Moreover, electrochemical machining methods of the present disclosure may be used to impart small scale surface texturing that further reduce aerodynamic drag and manage boundary layer separation beyond the hydraulically smooth limits.

It is to be understood that the above description is intended to be illustrative, and not restrictive. Numerous changes and modifications may be made herein by one of ordinary skill in the art without departing from the general spirit and scope of the disclosure as defined by the following claims and the equivalents thereof. For example, the above-described embodiments (and/or aspects thereof) may be used in combination with each other. In addition, many modifications may be made to adapt a particular situation or material to the teachings of the various embodiments without departing from their scope. While the dimensions and types of materials described herein are intended to define the parameters of the various embodiments, they are by no means limiting and are merely exemplary. Many other embodiments will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Also, the term "operably" in conjunction with terms such as coupled, connected, joined, sealed or the like is used herein to refer to both connections resulting from separate, distinct components being directly or indirectly coupled and components being integrally formed (i.e., one-piece, integral or monolithic). Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure. It is to be understood that not necessarily all such objects or advantages described above may be achieved in accordance with any particular embodiment. Thus, for example, those skilled in the art will recognize that the systems and techniques described herein may be embodied or carried out in a manner that achieves or optimizes one advantage or group of advantages as taught herein without necessarily achieving other objects or advantages as may be taught or suggested herein.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments have been described, it is to be understood that aspects of the disclosure may include only some of the described embodiments. Accordingly, the disclosure is not to be seen as limited by the foregoing description, but is only limited by the scope of the appended claims.

This written description uses examples, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A method for electrochemical machining a metallic workpiece comprising a metallic substrate to form a turbine blade, the method comprising:

applying a plurality of electric potential pulses over a period of time to cause current flow between an electrode and a metallic substrate having an electrolyte between the electrode and the metallic substrate, a first plurality of the plurality of electric potential pulses having a first electric potential (V1) and a first duration (t1) to cause current flow in a first direction between the electrode and the metallic substrate to drive a reduction process, and a second plurality of the plurality of electric potential pulses having a second electric potential (V2) and a second duration (t2) to cause current flow in a second direction opposite to the first direction between the electrode and the metallic substrate to drive oxide removal, the first electric potential (V1) being greater than the second electric potential (V2), the first duration (t1) being greater than the second duration (t2), and the first plurality of the plurality of electric potential pulses being interspersed with the second plurality of the plurality of electric potential pulses, the first plurality of the plurality of electrical pulses further comprising a third electric potential (V3) and a third duration (t3) to also cause current flow in a first direction between the electrode and the metallic substrate, wherein the first electric potential (V1) is greater than the third electric potential (V3) and the first duration (t1) is greater than the third duration (t3);

moving the electrode and/or the metallic substrate toward each other, at a feed rate between about 0.01 inches per minute and about 0.25 inches per minute, while applying the first plurality and the second plurality of the plurality of electric potential pulses over the period of time to electrochemically machine a portion of the metallic substrate; and wherein the metallic substrate comprises a nickel-based superalloy comprising nickel, cobalt, and chromium, and the electrochemically machined metallic substrate after the period of time comprises a surface having an average arithmetic surface roughness less than a surface roughness of an electrochemically machined metallic substrate formed with an applied electric potential resulting in current flow in only one direction, wherein moving the electrode and/or the metallic substrate toward each other while applying the plurality of electric potential pulses over the period of time removes a portion of the metallic substrate having a thickness greater than 0.02 inch to form at least a portion of the turbine blade; and wherein the electrochemically machined metallic substrate after the period of time comprises a surface having an average arithmetic surface roughness less than about 20 microinch.

2. The method of claim 1 wherein the metallic substrate comprises a first configuration, the electrode comprises a second configuration the reverse of which is different from the first configuration, and wherein the moving comprises moving the electrode and/or the metallic substrate toward each other while applying the first plurality and the second plurality of the plurality of electric potential pulses over the period of time to electrochemically machine a portion of the metallic substrate so that the first configuration of the metallic substrate has a reverse configuration of the electrode.

3. The method of claim 1 wherein the first duration (t1) of the first electric potential pulses comprise about 0.1 second to about 1 second, and the second duration (t2) of the second electric potential pulses comprise about 0.10 second to about 0.125 second.

4. The method of claim 1 wherein the applying comprises alternating pulses of the first plurality of the plurality of pulses with pulses of the second plurality of the plurality of pulses.

5. The method of claim 1 wherein the first electric potential (V1) comprises about 8 volts to about 28 volts, and the second electric potential (V2) comprises about 0.5 volts to about 10 volts.

6. The method of claim 1 wherein the first duration (t1) comprises about 0.25 second, and the second duration (t2) comprises about 0.125 second.

7. The method of claim 1 wherein the nickel-based superalloy comprises about 60 percent nickel, about 10 percent cobalt, about 8 percent to about 14 percent chromium, and about 4 percent to about 10 percent tungsten.

8. The method of claim 1 wherein the electrolyte comprises about a 10 percent to about 30 percent by weight aqueous solution of sodium nitrate.

9. The method of claim 8, wherein the electrolyte is buffered with sodium hydroxide to a pH of 9.

10. The method of claim 1 wherein the first electric potential (V1) comprises about 8 volts to about 28 volts, the second electric potential (V2) comprises about 0.5 volts to about 10 volts, the first duration (t1) comprises about 0.1 second to about 1 second, and the second duration comprises about 0.01 second to about 0.125 second.

11. The method of claim 10, wherein the third electric potential (V3) comprises about 0.5 volts and the third duration (t3) comprises about 50 milliseconds.

12. The method of claim 1, wherein a pulse frequency of the plurality of electric potential pulses is between about 4 Hz and about 20 Hz.

13. The method of claim 1, wherein moving the electrode and/or the metallic substrate toward each other while applying the first plurality and the second plurality of the plurality of electric potential pulses over the period of time to electrochemically machine a portion of the metallic substrate comprises moving the electrode and/or the metallic substrate to maintain a constant gap between the electrode and the metallic substrate.

14. The method of claim 13, wherein the constant gap is between about 0.010 inches and about 0.060 inches.

15. The method of claim 1, wherein the electrode comprises copper and tungsten.

16. The method of claim 1, wherein the metallic substrate comprises about 60 percent nickel, 14 percent chromium, 10 percent cobalt, 5 percent titanium, 4 percent molybdenum, 4 percent tungsten, 3 percent aluminum, 0.17 percent carbon, 0.015 percent boron, and 0.03 percent zirconium.

17. The method of claim 1, wherein the metallic substrate comprises about 62 percent nickel, 9.5 percent cobalt, 9.5 percent tungsten, 8.4 percent chromium, 5.5 percent aluminum, 3.05 percent tantalum, and 1.50 percent hafnium.

18. The method of claim 1, wherein a pressure of the electrolyte is 100 psi.

19. The method of claim 1, further comprising pumping the electrolyte towards a gap between the electrode and the metallic substrate to flush away a metal removed from the metallic substrate.

20. The method of claim 1, wherein the third electric potential (V3) maintains chemical activity at a surface of the metallic substrate.

21. A method for electrochemical machining a metallic workpiece comprising a metallic substrate to form a turbine blade, the method comprising:

applying a plurality of electric potential pulses over a period of time to cause current flow between an electrode and the metallic substrate having an electrolyte between the electrode and the metallic substrate, a first plurality of the plurality of electric potential pulses having a first electric potential (V1) and a first duration (t1) to cause current flow in a first direction between the electrode and the metallic substrate to drive a reduction process, and a second plurality of the plurality of electric potential pulses having a second electric potential (V2) and a second duration (t2) to cause current flow in a second direction opposite to the first direction between the electrode and the metallic substrate to drive oxide removal, the first electric potential (V1) being greater than the second electric potential (V2), the first duration (t1) being greater than the second duration (t2), and the first plurality of the plurality of electric potential pulses being interspersed with the second plurality of the plurality of electric potential pulses, the first plurality of the plurality of electrical pulses further comprising a third electric potential (V3) and a third duration (t3) to also cause current flow in the first direction between the electrode and the metallic substrate, and to maintain chemical activity at the electrode surface, wherein the first electric potential (V1) is greater than the third electric potential (V3) and the first duration (t1) is greater than the third duration (t3), wherein the first electric potential (V1) is about 8 volts, the second electric potential (V2) is about 1 volt, and the third electric potential (V3) is about 0.5 volts;

moving the electrode and/or the metallic substrate toward each other, at a feed rate between about 0.01 inches per minute and about 0.25 inches per minute, while applying the first plurality and the second plurality of the plurality of electric potential pulses over the period of time to electrochemically machine a portion of the metallic substrate; and wherein the metallic substrate comprises a nickel-based superalloy comprising nickel, cobalt, and chromium, and the electrochemically machined metallic substrate after the period of time comprises a surface having an average arithmetic surface roughness less than a surface roughness of an electrochemically machined metallic substrate formed with an applied electric potential resulting in current flow in only one direction, wherein moving the electrode and/or the metallic substrate toward each other while applying the plurality of electric potential pulses over the period of time removes a portion of the substrate having a thickness greater than 0.02 inch to form at least a portion of the turbine blade; and wherein the electrochemically machined metallic substrate after the period of time comprises a surface having an average arithmetic surface roughness less than about 20 microinch.

22. The method of claim 21, wherein the first duration (t1) comprises about 0.1 second to about 1 second, the second duration (t2) comprises about 0.1 second to about 0.125 seconds, and the third duration (t3) comprises about 50 milliseconds.

* * * * *